United States Patent [19]

Winston

[11] Patent Number: 5,054,772

[45] Date of Patent: Oct. 8, 1991

[54] JUMP ROPE HANDLE

[76] Inventor: Edith Winston, 135 Hazelwood Dr., Jericho, N.Y. 11735

[21] Appl. No.: 556,324

[22] Filed: Jul. 20, 1990

[51] Int. Cl.[5] ..... A63B 5/20

[52] U.S. Cl. ..... 272/75

[58] Field of Search ..... 272/74, 75, 78; 273/26 E

[56] References Cited

U.S. PATENT DOCUMENTS

| | | | |
|---|---|---|---|
| 3,363,898 | 1/1968 | Crovello | 272/75 |
| 4,101,123 | 7/1978 | Anthony | 272/75 |
| 4,136,866 | 1/1979 | Bouvier | 272/75 |
| 4,157,827 | 6/1979 | Winston et al. | 272/75 |
| 4,489,934 | 12/1984 | Miller | 272/75 |
| 4,593,899 | 6/1986 | Miller | 272/75 |
| 4,801,137 | 1/1989 | Douglass | 272/75 |

*Primary Examiner*—Richard J. Apley
*Assistant Examiner*—L. Thomas

[57] ABSTRACT

A jump rope handle having a ball bearing about the end of the "rope" inserted in the handle in which the opposite sides of the bearing outer race are held between a flange and the exercise weight which in practice has been found to cause a spinning mode in the inner race which generates a greater rope-turning speed during exercising use of the jump rope.

2 Claims, 2 Drawing Sheets

JUMP ROPE HANDLE

The present invention relates to improvements in handle grips for a jump rope of the type using a metal weight in each handle grip, and wherein the jump rope ends are disposed internally of the handle grips and within ball bearings so that these ends do not twist or are otherwise restrained which correspondingly might adversely effect the turning speed that can be generated in the jump rope during the exercising use thereof.

EXAMPLE OF THE PRIOR ART

The use of weights and ball bearings in the construction of jump rope handle grips is already well known, as exemplified by U.S. Pat. No. 4,801,137 issued on Jan. 31, 1989 to Douglass. In Douglass, as in the within inventive handle grip, the ball bearing is in the front or end of the handle which receives the end of the jump rope or line. In Douglass, the outer ball bearing race is force fit in seated relation in an outwardly facing internal shoulder which, although convenient for positioning the ball bearing, requires the use of a threaded closure cap or plug in the end of the grip handle to hold the ball bearing in place during use of the jump rope. This closure cap component can work itself loose and adds to complexity of the handle grip construction.

Broadly, it is an object of the present invention to overcome the foregoing and other shortcomings of the prior art. More specifically, it is an object to obviate the use of a grip handle threaded closure cap or similar rotatably attached component which as an inadvertent consequence of the rotation of the handle during use can loosen by reverse direction rotation.

As will be subsequently explained in greater detail, in contrast to Douglass, the ball bearing outer race in the within inventive handle grip is interposed between a stationary inwardly facing shoulder and the exercise weight, the latter component during exercise rotation of the jump rope moving, undoubtedly due to centrifugal force, into firm holding contact against the outer ball bearing race and thus not only held in place within the handle grip with a significantly simplified construction, but it has been found that during the wrist motion which produces the turning of the jump rope that a spinning mode is generated in the inner ball bearing race relative to the stationary outer ball bearing race, and this contributes to a correspondingly greater turning speed being generated in the jump rope.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
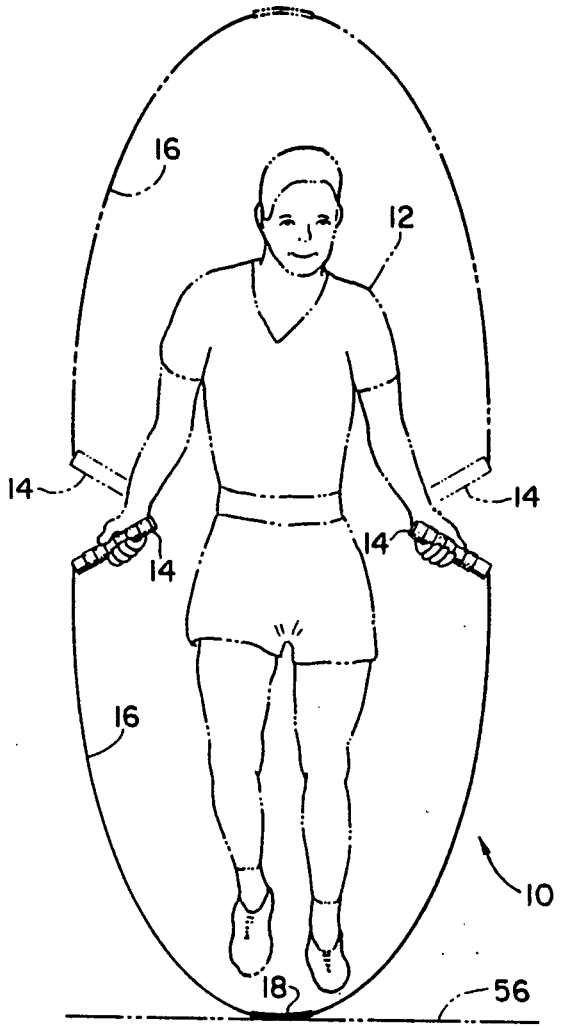
FIG. 1 is a front elevational view illustrating exercising use of a jump rope with handle grips according to the present invention.

FIG. 1 illustrates a jump rope 10 as typically used by a person 12 in an exercise routine. Jump rope 10 consists of identical handle grips 14 connected at opposite ends to a length of line 16 protected against wear at the location at which it strikes surface 56 by a spring 18.

Line 16 is preferably made of one-quarter diameter leather, but can be made of a rubber construction material or one of the many woven fiber cords commercially available.

Figure 2:
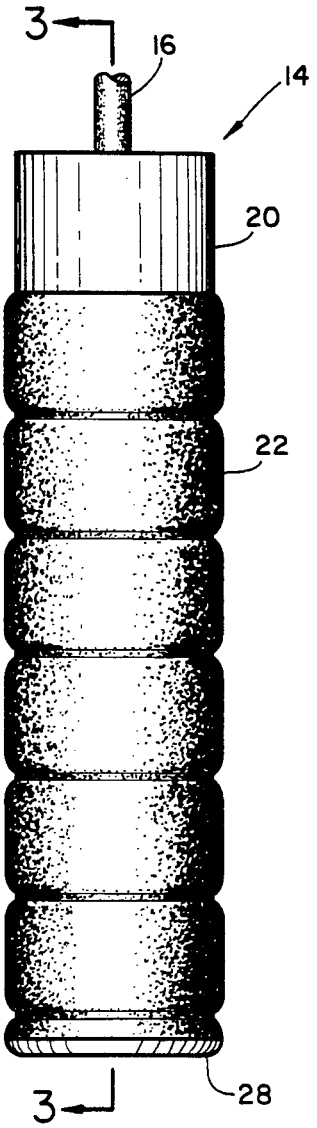
FIG. 2 is an isolated elevational view of the within inventive jump rope handle grips.
Figure 3:
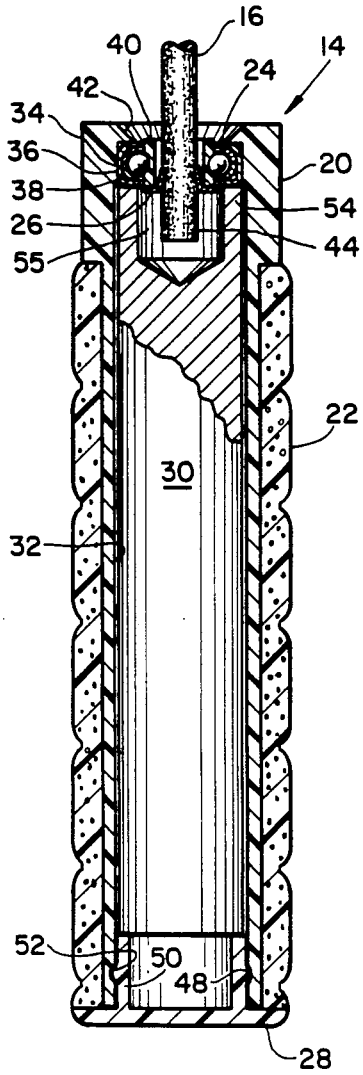
FIG. 3 is a cross sectional view as taken along line 3—3 of FIG. 2.
Figure 5:
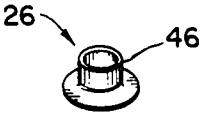
FIG. 5 is a detail perspective view of a handle grip component.

Each of the handles 14, as best seen in FIG. 3, generally comprises an assembly of a housing 20, a heavy sculptured foam covering 22, a line ball bearing 24, a line anchor 26, a housing end closure plug 28 and a cylindrical shaped metal exercise weight 30. More specifically, housing 20 is of plastic construction material molded with a through bore 32 serving as a storage compartment for the exercise weight 30, the said housing terminating at one end with an end wall or an inturned circular flange 42 which internally forms a seat 36 only for the outer race 38 of the ball bearing 24, while permitting the ball bearing inner race 40 to rotate freely in relation therewith. That is the inner race 40 of bearing 24 along with line 16 in its projected operative position through the central opening of the flange or housing end 42 is free to rotate within the outer ball bearing race 38. The edge of the flange control opening is chamfered as clearly illustrated in FIG. 2 to facilitate the projecting of the line end 44 within the handle grip 14. The end 44 of line 16 is retained with inner race 40 by line anchor means 26, one preferred embodiment of which is a grommet or flanged eyelet 46, as shown in FIG. 5, whose collar is crimped about end 44 of line 16. If the exerciser 12 desires to shorten line 16, he or she can remove the end housing plug 28 and weight 30 and then thread line 16 through the bore or compartment 32 to where the desired length can be cut off shortening the line 16.

Since, according to the present invention, jump rope 10 is used with the exercise weight 30, the removable closure plug 28 is provided with an annular ridge 48 on the outer surface of its collar extension 50 to obviate inadvertent dislodgement. Ridge 48 cooperates with an appropriate annular groove 52 within housing 20. For both comfort and enhanced gripping, the outside of handle 14 is covered by a foam covering 22 which provides a non-slip gripping surface, even though the user may perspire heavily.

On its end 54 adjacent the line end 44, weight 30 is provided with a blind drilled hole serving as a clearance chamber 55 about the inwardly projected end 44 of line 16. When weight 30 is in place, the peripheral edge 54 thereof which bounds the chamber bears against the ball bearing outer race 38 of bearing 24 to thereby hold bearing 24 within its seat 36. When plug 28 is snapped in place, weight 30 is itself held in its bearing-holding position within housing 20, even though there is sliding clearance between the diameter of the weight 30 and the diameter of storage compartment 32.

Figure 6:
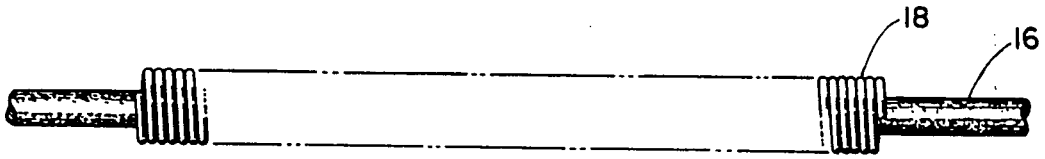
FIG. 6 is a detail elevational view of an exercise rope component.

Shown in detail in FIG. 6 is one form of optional line protector 18. Depending on the exercise routine of the rope jumper, the center portion of line 16 may be subject to repeated impact against floor 56 resulting in line wear and eventual line failure. Protector 18 consists of a closely wound spiral of 1/16" diameter plastic which is assembled around line 16 and, in use, will find its position as shown on line 16 due to centrifugal force when jump rope 10 is in use.

Figure 4:
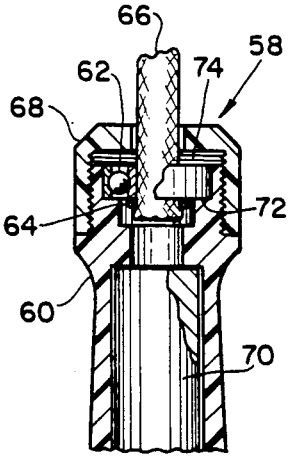
FIG.4 PRIOR ART
FIG. 4 is a partial cross sectional view similar to FIG. 3, but of a prior art handle grip, for comparison with FIG. 3.

In the prior art FIG. 4 a detail of part of a jump rope handle 58 is shown specifically for comparison with FIG. 3, and to better demonstrate the simplicity in construction which characterizes the within inventive handle grip 14. Handle 58 has a housing 60, a line bearing 62, a line 66, a housing closure cap 68 and a weight 70. Unlike in handle 14, bearing 62 is embodied in handle 55 by being positioned on an outwardly facing inboard seat 72. Threaded cap 68 is accordingly required to close the bearing chamber 74.

In holding the opposite sides of the outer race 38 between the flange 42 and exercise weight 30, the bearing 24 is held in place in its operative position within the handle 14 with a simplified construction, i.e. without a housing closure cap 68. Additionally, and surprisingly, it has been found that greater rope-turning speeds can be generated because of the construction of handle 14. Not only does the normal wrist movement of the exerciser contribute to the rope-turning speed, but the stationary position of the bearing 24 and, more particularly, the unrestricted rotation of inner race 40 relative to the stationary outer race 38 is believed to provide a spinning mode in the inner race 40 which adds to the turning of the line ends 44, and correspondingly adds to the turning speed of the rope imparted by the user's wrist movement.

While the particular jump rope handle grip herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A pair of handle grips for each of the opposite ends of an exercise rope comprising for each a hollow cylindrical housing bounding an internal exercise weight storage compartment, said housing having an inturned flange of a prescribed length at one end forming an internal shoulder at one end of said storage compartment and having a weight-insertion opening into said storage compartment at said opposite end, a ball bearing consisting of an outer race and an inner race and having a central opening therethrough having an operative position with said outer race disposed in seated relation in said housing internal shoulder and said inner race freely rotatable in relation therewith, an exercise weight sized to fit in said housing storage compartment and having an end clearance chamber disposed through said housing weight-insertion opening into said storage compartment with an edge of said exercise weight bounding said end clearance chamber positioned in holding relation against said ball bearing outer race on the side opposite said shoulder, and an exercise rope having each opposite end projected through said ball bearing central opening into each said weight end clearance chamber and having retaining means thereon preventing reverse direction movement thereof, whereby in the rotating use of said exercise rope the rotation thereof is enhanced by the rotation of said ball bearing inner race.

2. A handle grip as claimed in claim 1 including a closure for said weight-insertion opening comprising a cylindrical plug having an annular ridge which projects into a cooperating annular groove of a wall which bounds said weight-insertion opening, whereby said plug will not inadvertently unthread and will remain in its operative position as a closure during use of said jump rope.

* * * * *